United States Patent [19]

Chevion

[11] Patent Number: 4,730,667

[45] Date of Patent: Mar. 15, 1988

[54] LIQUID TO SOLIDS HEAT EXCHANGER

[76] Inventor: Alex Chevion, 14 Tremont Ter., Livingston, N.J. 07039

[21] Appl. No.: 870,638

[22] Filed: Jun. 4, 1986

[51] Int. Cl.[4] ..... F28F 5/00

[52] U.S. Cl. ..... 165/84; 165/86; 165/120; 432/83; 432/134; 62/378; 62/380

[58] Field of Search ..... 165/120, 86, 84; 122/27; 432/83, 134, 135; 62/63, 378, 380

[56] References Cited

U.S. PATENT DOCUMENTS

| | | | |
|---|---|---|---|
| 694,958 | 3/1902 | Galschiot | 122/27 |
| 810,864 | 1/1906 | Hoover et al. | 62/380 |
| 939,936 | 11/1909 | Wilfley | 432/134 |
| 1,358,327 | 11/1920 | Reecke | 432/83 |
| 1,847,956 | 3/1932 | Giger | 62/63 |
| 1,968,543 | 7/1934 | Udell | 62/63 |
| 2,661,751 | 12/1953 | Schenk | 62/378 |
| 2,805,841 | 9/1957 | Kyle | 165/92 |
| 2,812,169 | 11/1957 | Felbeck et al. | 165/120 X |
| 2,844,359 | 7/1958 | Annerhed | 62/380 |
| 3,031,144 | 4/1962 | Suga | 165/120 X |
| 3,228,206 | 1/1966 | Lockerby | 62/378 |
| 3,425,237 | 2/1969 | McLeese | 165/120 X |
| 3,684,005 | 8/1972 | Ellithorpe et al. | 165/120 X |
| 3,705,620 | 12/1972 | Kayatz | 432/83 |
| 3,824,068 | 7/1974 | Kobayashi et al. | 432/83 X |
| 3,830,291 | 8/1974 | Ellithorpe et al. | 165/120 |

FOREIGN PATENT DOCUMENTS

| | | | |
|---|---|---|---|
| 2153435 | 5/1973 | Fed. Rep. of Germany | 165/120 |
| 2805148 | 8/1979 | Fed. Rep. of Germany | 432/83 |
| 1358592 | 3/1964 | France | 165/120 |

*Primary Examiner*—Albert W. Davis, Jr.
*Attorney, Agent, or Firm*—Jack Matalon

[57] ABSTRACT

The invention relates to a liquid to solids heat exchanger and to a process for retorting carbon-containing solids (e.g. oil shale) using such heat exchanger. The heat exchanger contains a liquid pool reservoir, heat source or heat sink for heating or cooling the liquid pool, a support for the solids such that there is heat exchange between the solids and the liquid pool without direct contact of the solids and the liquid pool, and oscillators or vibrators to cause the solids to be conveyed while exchanging heat with the liquid pool.

25 Claims, 8 Drawing Figures

LIQUID TO SOLIDS HEAT EXCHANGER

BACKGROUND OF THE INVENTION

This invention relates to the heating and cooling of solid materials by heat exchange with liquids as well as to the thermal decomposition, also called retorting, of solids such as oil shale, coal, industrial and municipal wastes, and the like, hereinafter referred to as carbon containing solids. Retorting involves the heating of such solids to temperatures at which they thermally decompose, releasing hydrocarbons, such as oil vapors and gases, which are then converted into fuels. Oil shale, which contains a minor amount of organic matter called kerogen and a major amount of mineral matter, is considered one of the best candidates of all carbon containing solids for the production of motor and heating fuels.

Processes for recovering hydrocarbonaceous products from raw oil shale are generally classified into four categories according to the method in which the heat is supplied. These categories are as follows: (1) heat is transferred from an external source through the walls of the retorting vessel; (2) heat is supplied by direct combustion in the retorting vessel; (3) heat is supplied by passing an external heated gas into the retorting vessel; (4) heat is supplied by introducing externally heated solids into the retorting vessel. It is noteworthy that the processes falling into category (1), to which the process of the invention belongs, have heretofore attracted very little interest. Nevertheless, category (1) has a number of advantages over other categories provided that its present drawbacks could be eliminated. This is achieved in this invention by a novel means for liquids to solids heat exchange whereby the solids are conveyed by an oscillating motion on a continuous conveying path while exchanging heat with suitable heat transfer media such as liquid metals. The conveying path preferably includes a retorting zone and a cooling zone in which heat is recovered from cooling of the oil shale and utilized for its retorting for substantial fuel savings.

The heat exchanger of this invention is applicable not only to retorting, but also to heating or cooling of solid materials in general. The liquid to solids heat exchange, and in particular, the exposure of a wall in an oscillating pan for a pressurized contact with a liquid through immersion in a liquid pool are distinctly different from the prior art.

Characteristically, the prior art comprises an oscillating chamber for this purpose. The liquid flows in the chamber, which may be rectilinear or helical, not unlike in a conduit while exchanging heat with the solid materials. U.S. Pat. No. 2,805,841 describes a typically illustration of such a chamber. In a heating application, referred to in the patent, albeit not shown on its drawings, the liquid flows inside the chamber by gravity while being pumped to or from an external heat source in order to transfer heat therefrom to the solid materials. The liquid of necessity flows by gravity because the pipes supplying the liquid cannot be connected to the chamber except by flexible piping connections. However, the latter are feasible only for liquid temperatures which are substantially below the peak retorting temperature. A submersed piping asembly for heating, as in this invention, is also precluded for the same reason, because this would necessitate flexible piping connections between the piping assembly inside the oscillating chamber and the piping supplying the heating fluid.

The drawbacks of the prior art are avoided in this invention. This is achieved by the immersion of an oscillating pan in a liquid pool which is contained in a reservoir. An advantage of the reservoir over the prior art is that liquid metals can be safely contained and heated therein by a fluid flowing inside a submersed piping assembly. The oil shale or other solid materials can therefore be heated to higher temperatures than heretofore possible. Another advantage over the prior art is that the immersion causes the liquid to exert an upward pressure on the pan which besides exposing the liquid for a pressurized contact with the pan is also a means to cancel out the "dead loads" due to the weight of the pan and the solid materials thereon.

Another drawback of the prior art which is eliminated by this invention results from the difference in temperature between the upper wall and the bottom wall of the chamber. The upper wall is exposed to solid materials and to a liquid whereas the bottom wall is exposed only to a liquid. The resulting temperature difference produces a difference in the thermal expansion of the walls, which induces stresses. Although the severity of the stresses will depend on a number of factors besides temperature, there is nonetheless a temperature limit beyond which the chamber will rupture. This drawback is avoided in this invention because the duct underneath the wall has no bottom. The oscillating pans have yet another advantage because they can form a continuous conveying path by overlapping one pan on top of another. Unlike in the prior art, the thermal expansion increases the amount of overlap but not the total length of the conveying path. The terminals of the conveying path stay therefore near their original location. A much longer conveying path and larger heating capacities as well as higher temperatures, than in the prior art, can thus be achieved.

SUMMARY OF THE INVENTION

The heat exchanger of this invention comprises:

(a) a liquid pool within a reservoir;

(b) means for heating and cooling said liquid pool;

(c) at least one wall for supporting the solids, said wall being immersed in said liquid pool such that the bottom surface but not the top surface is in contact with the liquid pool;

(d) means for imparting an oscillatory motion to said wall thereby causing any solids present on said top surface to be conveyed along the top surface while exchanging heat with the liquid pool.

Preferably the wall contains a duct which communicates with and is disposed beneath the bottom surface such that the bottom surface forms a closure for one end of the duct with the other end of the duct being immersed in the liquid pool such that the bottom surface but not the top surface is in contact with the liquid pool and the level of the liquid pool within the duct is at a higher elevation than the level of the liquid pool outside the duct. Further, it should be understood that, for the purposes of this invention, the term "immerse" is intended to cover embodiments wherein the wall is plunged or dipped into the liquid pool as well as those wherein the liquid pool is drawn up (e.g. through a duct by application of vacuum) to contact the bottom surface of the wall.

The process for pyrolyzing the carbon-containing solids (e.g. oil shale) to produce hydrocarbons comprises:

(a) transferring heat from a liquid pool to the solids contained on a surface by immersion of the surface in the pool such that there is not direct contact between the solids and the pool, thereby pyrolyzing the solids; and (b) recovering the hydrocarbons from the pyrolzed solids.

The preferred mode of the process involves additionally:

(c) transferring heat from the pyrolyzed solids contained on said surface to a liquid pool by immersion of the surface in the liquid pool such that there is no direct contact between the pyrolyzed solids and the pool; thereby cooling the pyrolyzed solids; and (d) conveying the carbon-containing solids and the pyrolyzed solids along said surface by means of an oscillatory motion imparted to the surface such that the carbon-containing solids and the pyrolyzed solids form a substantially continuous layer, said pyrolysis occurring in a first zone of the layer, and said cooling occurring in a second zone of the layer located downstream of, and substantially contiguous to, the first zone.

DESCRIPTION OF THE DRAWINGS

Referring to FIGS. 1, 2 and 3, the heat exchanger of this invention includes a first unit on which solids are deposited from hopper 38 and a last unit from which the solids are discharged through duct 63 and chute 32 into hopper 39. The heat exchanger preferably includes a plurality of intermediate units having the same configuration as that of the last unit except for duct 63 and chute 32 which would be omitted. Such preferable intermediate untis are disposed between the first and last units as shown in FIG. 8.

Figure 1:
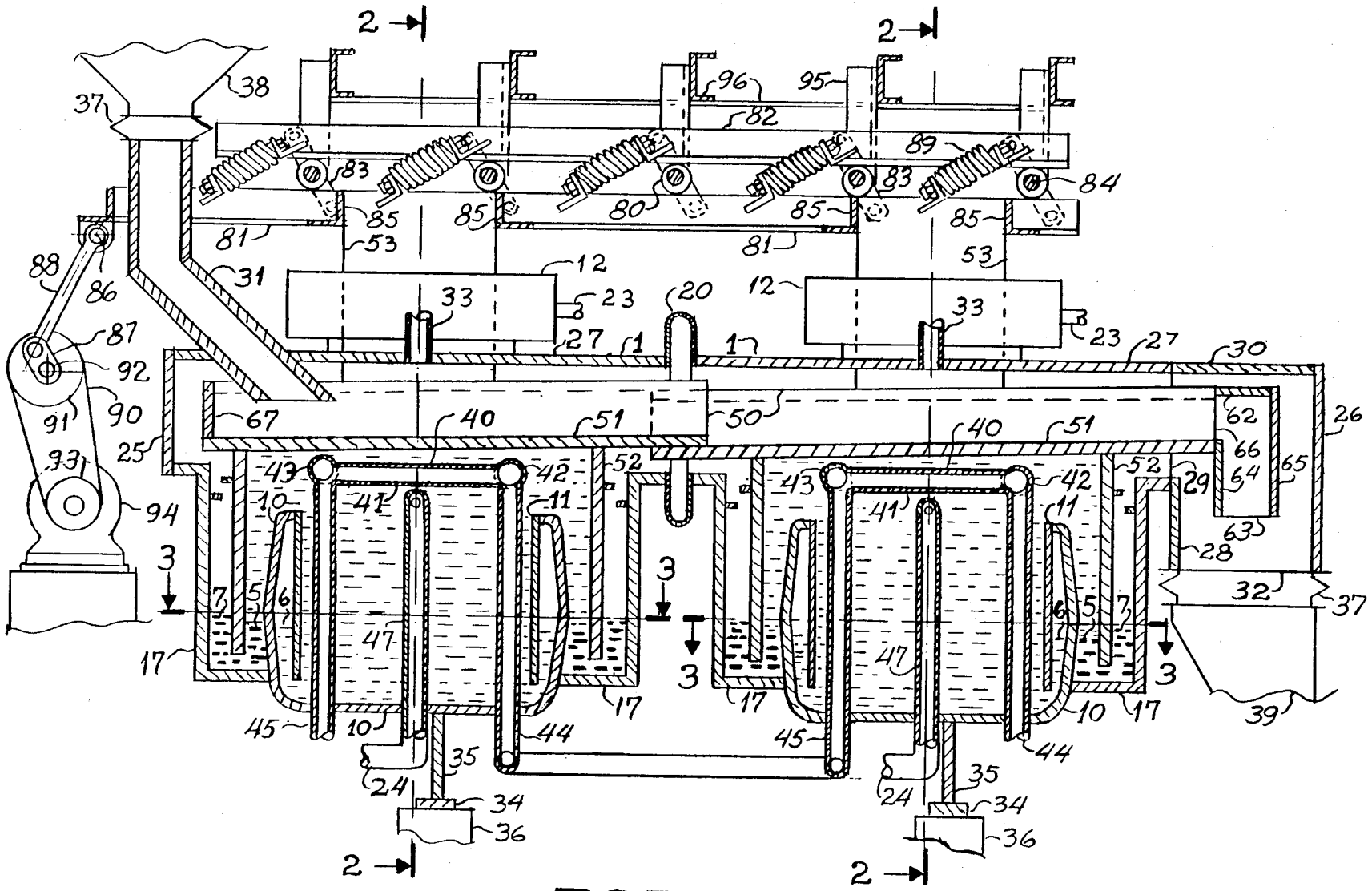
FIG. 1 is a longitudinal view of the heat exchanger of this invention, in section, taken along line 1—1 shown in FIG. 2.

Each unit, whether it is the first unit, last unit, or an intermediate unit, comprises a liquid pool contained in reservoir 1, and a pan 50 consisting of wall 51, duct 52 and guards or side walls 54. The liquid pool comprises one or more liquids, but preferably comprises two liquids. One of the preferred liquids is a sodium-potassium alloy. This liquid extends from guards 54 and from wall 51 to an interface with a buffer liquid at line 5 and to an interface with an inert gas (preferably nitrogen) at line 6. The buffer liquid occupies the spaces between vessel 10 and duct 52 up to line 5, and between duct 52 and walls 16 and 17 up to line 7. The buffer liquid is preferably an alloy of two or more fusible metals which is inert to the gases present above line 7. The selections of the liquids for the liquid pool, the buffer liquid and inert gas are not critical; suitable choices may be found in P. L. Giringer's book entitled "Heat Transfer Media".

The solids are supplied on the top surfaces of wall 51 and conveyed thereon by an oscillatory motion while exchanging heat with the liquid pool which is heated or cooled by conduit assembly 40. The transversely parallel bars 53 communicate with oscillating mechanism 80 which imparts an oscillatory motion to wall 51 and duct 52. The bottom surface of wall 51 forms a gas-tight closure for the top end of duct 52. Pan 50 is, by means of bars 53, dispsoed at an elevation such that the bottom end of duct 52 is immersed in the liquid pool. A vacuum inside duct 52 lifts the liquid pool inside duct 52 up to the bottom surface of wall 51 causing the liquid pool to exert an upward pressure on wall 51. The use of a vacuum together with the immersion makes it possible for the liquid pool inside duct 52 to be in a presurized contact with the bottom surface of wall 51. The liquid level of the pool outside duct 52 will thus be at a lower level than that inside duct 52, thus keeping the liquid pool at a safe distance from that end of wall 51 from which the solids depart, i.e. the liquid pool is thereby prevented from contacting the top surface of wall 51 and the solids contained thereon.

For the purposes of this invention, the term "pan" (no. 50) is intended to connote a structure capable of supporting solids. Such structure may have the shape of a trough, tray, deck or the like. The wall 51 may be surrounded by guards, or vertical sidewalls on all sides except that corresponding to the solids discharging end. Duct 52 is preferably rectangular, but may have any other desired cross section, and each wall 51 may contain a plurality of ducts 52 on the bottom surface thereof. As may be seen from FIGS. 1–3, wall 51 preferably juts out from duct 52 so that the discharging and receiving ends of adjacent pans 50 can overlap. Such overlapping relationship makes it possible for multiple walls 51 to form a substantially continuous conveying path in which each pan 50 expands thermally at its own rate. Walls 51 are preferably only slightly inclined (e.g. 1–5 degrees) from the horizontal to the extent required for an overlapping relationship. Transverse plate 67 is attached to wall 51 of the first pan 50 upstream of chute 31. Duct 63 which comprises transverse plates 64 and 65, two parallel side plates 66 and top plate 62, is attached to the discharging end of the last pan 50.

Reservoir 1 comprises outside walls 16 and 17, cover 27, vessel 10 and ancillary piping. Walls 16 and 17 are plates with a bottom flange which is joined to vessel 10. Walls 17 also contain an upper flange which together with walls 16 and cover 27 form a duct-like extension at the entrance and exit from reservoir 1. The plurality of reservoirs with transverse plate 25 in the rear of the first unit and chute 32 in front of the last unit and expansion joints 20 in between the units form a gas-tight enclosure which contains a plurality of liquid pools. Plate 35 is attached to vessel 10 and plate 34. Reservoir 1 supported by plate 34 on foundation 36 is free to expand thermally relative to the foundation. Chute 32 comprises plates 26, 28, 29 and 30; transverse plate 28 is attached to the upper flange of wall 17. Side plates 29 and plate 30 are extensions of walls 16 and cover 27, respectively. Bar 53 which passes through a slot in cover 27 is enclosed by liquid seal 12 which, together with hoppers 38 and 39 are well as chutes 31 and 32 form a gas-tight enclosure for the conveying path. Any gases present are admitted or withdrawn through conduit 33. Liquid seal 12 includes duct 13; bar 53 moves in an oscillatory motion inside duct 13. Ducts 13 and 14 which are connected by plate 15 form an annulus containing a liquid which may be water, an oil or a metal in the liquid state.

Duct 57, connected by plate 56 to bar 53, is immersed in such liquid while moving in unison with bar 53. Such liquid is partitioned by duct 57 into an inner liquid column (which interfaces with the gases present in reservoir 1 at line 18), and an outer liquid column (which interfaces with the outside air at line 19). Any required replenishment of such liquid may be carried out via conduit 23. Liquid droplets, thrown off due to the oscillatory motion of duct 57, are deflected by baffle bars 22 and 58. Similarly, liquid droplets thrown off by duct 52 are deflected by baffle bars 21 and 68.

Figure 8:
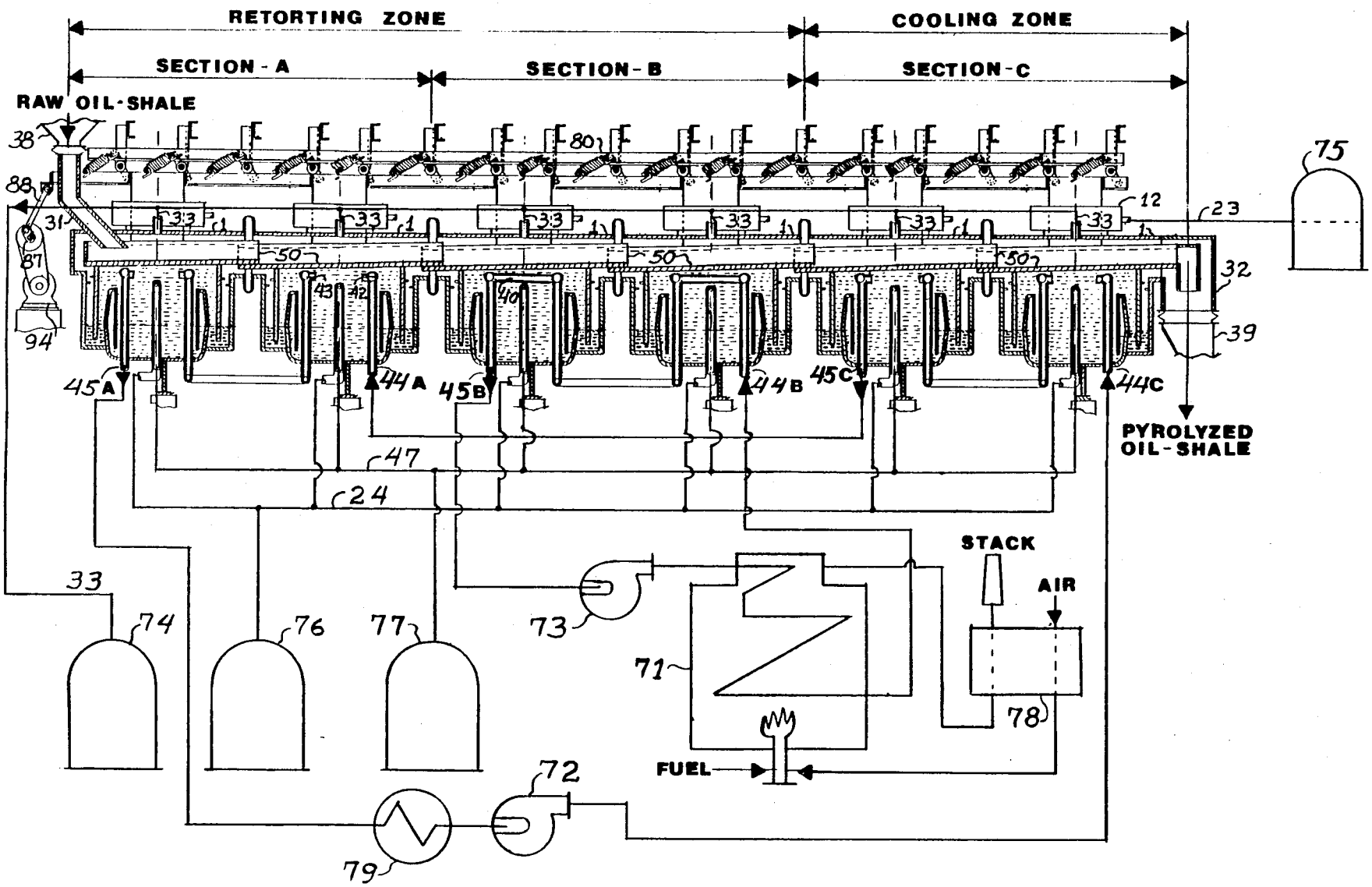
FIG. 8 is a flow schematic of the oil shale retorting process of the invention.

Conduits 24 and 47 (which in FIG. 1) are shown cut away near the exit from vessel 10) are connected to a nitrogen source 76 and to purge tank 77, respectively, as shown in FIG. 8. Conduit 47 passes through the shell of vessel 10 and through duct 11 to the outside of vessel 10 where it branches off into two conduits 46 which terminate under guards 54. Conduit assembly 40, supported on top of vessel 10, is the means utilized for heating or cooling of the liquid pool; conduit assembly 40 comprises a plurality of conduits 41 which are manifolded to transverse conduits 42 and 43.

Conduits 44 and 45 (the inlet and exit conduits, respectively) run through the shell of vessel 10 and inside duct 11 and connect to conduits 42 and 43 respectively. Conduits 44 and 45 (shown in FIG. 1 as being cut away near the exit from vessel 10) are connected to heat source (or sink) 71, as shown in FIG. 8. A fluid which flows inside conduit assembly 40 absorbs or rejects heat externally to the apparatus and transfers such heat to or from the liquid pool. The liquid pool may also be heated or cooled by being pumped to or from a heat source (or sink), as shown in FIG. 8.

Prior to filling reservoir 1 with the Na-K and buffer liquids, air is withdrawn through conduits 46 and replaced with nitrogen which enters through conduit 24. Thereafter, both liquids are introduced through conduits (not shown in the drawings) up to a level corresponding approximately to that of line 6. A vacuum drawn through conduit 46 causes the nitrogen in the area under pan 50 to be displaced by the liquids. The vacuum is drawn and both liquids are gradually added until they reach the levels correponding approximately to that of lines 5, 6 and 7.

The requisite pressures may be determined in accordance with the following equation in which the levels corresponding approximately to that of lines 5, 6 and 7 will be denoted by the symbol "h" with a subscript and referenced to a base line which is on the bottom surface of wall 51. For example, $h_7$ would denote the distance (in inches) from such base line to line 7. If $h_5$ is assumed to be equal to $h_6$ and have an assumed value of 30 inches, $h_7$ may now be calculated. Assume the liquid densities (in lbs./cu. in.) for the Na-K and buffer liquids to be 0.029 and 0.36, respectively. Assume further that the area of wall 51 inside duct 52 is 0.95 of the total area A and the area of the horizontal legs of both guards 54 to be 0.05 of A. Assume also that the total weight of pan 50 (including the weight of the solids thereon) to be W and the ratio W/A to be 0.6 psi. Assume p is the absolute pressure exerted by the liquid pool on the bottom surface of wall 51 and $p_6$ and $p_7$ to be the pressure at the respective levels, with $p_7$ assumed to be 15.0 psia. Then the equation would be:

$$p_7 \times A + W = 0.95A \times p = 0.05A\ (p - 7.0 \times 0.029)$$

$$p = 15.61 \text{ psia}$$

The left side of the equation represents the forces acting downward on pan 50 and the right side represents the forces acting upwards on pan 50. At p=15.61 psia, pan 50 and the solids thereon become "weightless" not unlike a free floating body. Such "weightlessness" is of particular advantage when two apparati are stacked atop one another and are driven by a single mechanism 80. The "weightless" condition produces a complete equality of the counteracting forces in mechanism 80 because the static loads are eliminated. Once p has been calculated, $h_7$ and $p_6$ may be calculated as follows:

$$(h_5 - h_7) \times 0.36 = p_7 = p + (h_5 \times 0.029)$$

$$h_7 = 25.89$$

$$p_6 p + (h_6 \times 0.029)$$

$$p_6 = 16.48 \text{ psia}$$

Levels $h_5$, $h_6$ and $h_7$ refere to the midpoint of the movement of pan 50 which moves not only to an fro but also up and down. Concurrent with the movement of the pan, the liquid at level 6 moves down and up as pan 50 moves up and down. However, the liquid is in a pressurized contact with wall 51 during the entire movement because of the upward pressure exerted as a result of the immersion plus the vacuum.

It is possible to choose liquids for the liquid pool which would eliminate the necessity for the use of nitrogen. For example, the liquid portion inside and outside the lower part of duct 11 may be replaced with an inert liquid such as the buffer liquid. In such case, conduit 24 on the outside of tank 1 may be connected to cover 27 instead of the nitrogen source. Thus, the gaseous spaces on the outside of duct 52 and duct 11 may be interconnected and the pressure above the liquids in those spaces would be equalized. Alternatively, the liquid pool may comprise a single liquid provided that such liquid is chemically inert towards the gases present in reservoir 1. It should be understood, however, that the advantageous condition of "weightlessness" cannot be achieved in a liquid pool comprising only one liquid.

Mechanism 80 is of the type normally used in oscillatory conveyors of the vibratory type. This mechanism comprises structural frames 81 and 82 which are pivoted to transversely parallel levers 83 which are fulcrumed at 84 in bearings 98 which are supported by brackets 95 from an overhead structure 96 supported on columns 97. Bars 53 are attached to angle irons 85 which are the transverse members of frame 81. Connecting rod 88 which is pinned at 86 to frame 81, is operatively connected at its other end to an eccentric 87 driven by belt 90 and pulleys 91 mounted on shaft 92. Belt 90 in turn is driven by electric motor 94 with pulley 93.

Connecting rod 88 (driven by eccentric 87) imparts an oscillatory motion to frame 81 such that frame 81 moves upward and forward as frame 82 moves rearward and downward in the opposite direction along the arcs prescribed by the pivoted connections at both ends of levers 83. The mass of frame 82 acts as a counterbalance to frame 81 and springs 89 being mounted thereon provide the necessary resiliency whereby mechanism 80 operates at the natural frequency.

Mechanism 80 is but one of many types of oscillatory means which may be employed to convey the solids on wall 51. Another suitable mechanism is of the type which is employed in shaker conveyors: their trajectory follows a straight line and not an arc as in mechanism 80. Yet another type of oscillatory mechanism is a pneumatic or magnetic vibrator which is capable of conveying solids by imparting high frequency oscillations (2000–8000 cycles per minute) to wall 51.

Duct 52 and the vacuum therein represent the principal elements which permit the formation of a relatively long conveying path from a plurality of relatively short oscillating pans, thereby avoiding problems due to excessive thermal expansion. Alternatively, but less preferred, is the plunging (or dipping) of a pan in the liquid pool with a different means for discharging the solids from the dipped pan. Nevertheless, for the purposes of this invention, the term "immersion" contemplates any suitable means for contact of the wall (or pan) containing the solids thereon with the liquid pool such that heat exchange with the pool will occur without any contact between the solids and the pool.

Figure 5:
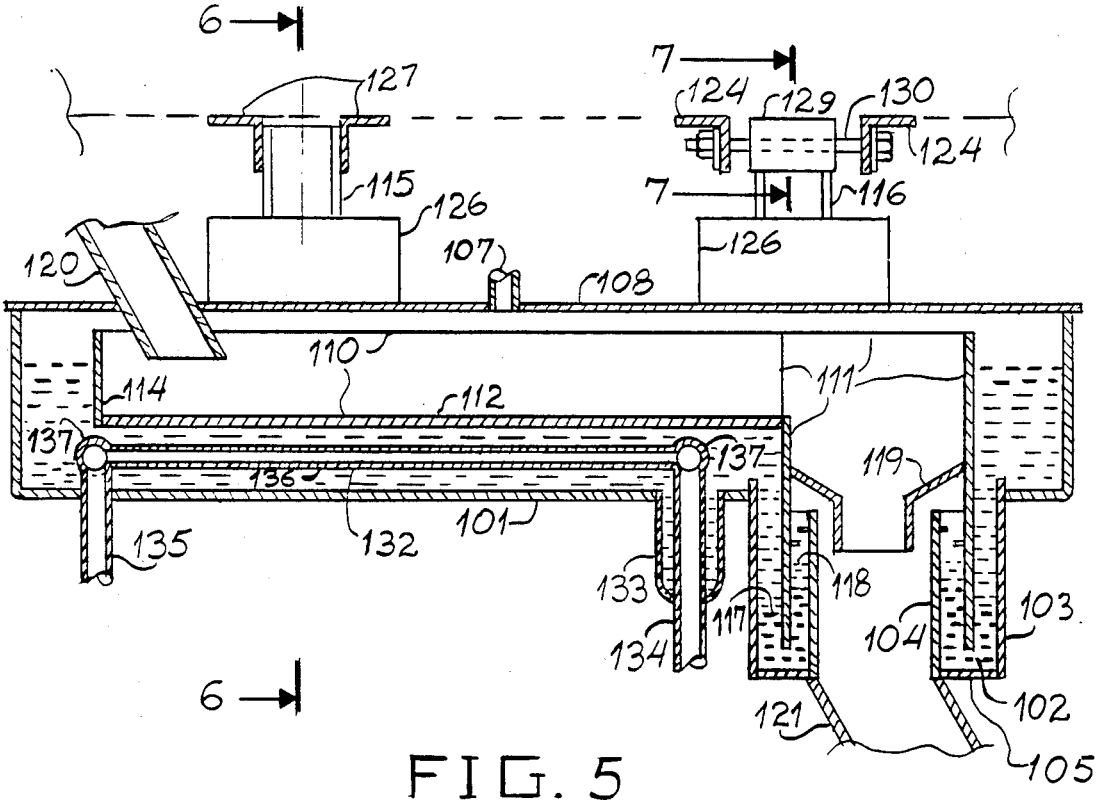
FIG. 5 is a longitudinal view of another embodiment of the heat exchanger of this invention, in section, taken along line 5—5 shown in FIG. 6.
Figure 6:
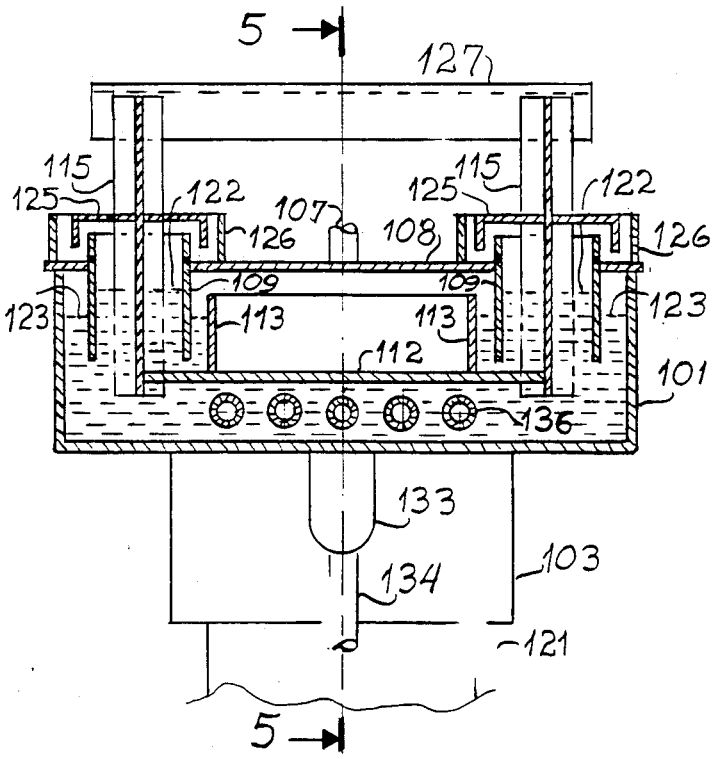
FIG. 6 is a side view, in section, taken along line 6—6 shown in FIG. 5.

Referring to FIGS. 5 and 6, duct 111 is connected to the discharging end of pan 110 which is horizontally disposed and dipped (i.e. immersed) in the liquid pool contained in reservoir 101. Wall 112 is below the top surface of the liquid pool while guards or side walls 113 and 114 extend above the top surface and duct 111 extends through the liquid pool into annulus 102. Annulus 102 is formed between outer duct 103 and inner duct 104 which are interconnected by plate 105. Duct 103 is connected to an opening at the bottom of reservoir 101, while duct 111 forms a liquid seal by immersion in the liquids contained in annulus 102. In this embodiment, the liquid pool consists, e.g. of one liquid which is a heat transfer oil. The liquid pool is heated or cooled by means of piping coil 132 comprising a plurality of pipes 136, manifolds 137 having exit pipe 135 connected to reservoir 101, and inlet pipe 134 connected to pipe cap 133.

Figure 7:
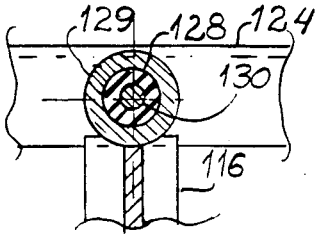
FIG. 7 is a sectional side view of a resilient sliding bushing, taken along line 7—7 shown in FIG. 5.

The liquid (s) in annulus 102 may be one or more Fusible Metals or molten salts preferably a liquefied metal. Duct 111 partitions the liquefied metal into an inner liquid column which interfaces with the liquid pool at line 117 and into an outer liquid column topped with an oil layer which interfaces with the air at line 118, duct 111 moves in an oscillating motion while being immersed in the liquids. The liquid columns exert an upward pressure on the liquid pool at line 117 thereby preventing it from flowing out from reservoir 101. Duct 119 (which is shaped like a funnel) is attached to duct 111 and directs the solids away from annulus 102. The oscillating motion is imparted to pan 110 through I-beams 115 and 116 and angle irons 127 and 124, respectively that are attached directly to an oscillating mechanism which is not shown but is similar to mechanism 80. I-beam 115 are fixedly attached whereas I-beams 116 are attached through a sliding connection thereby allowing pan 110 to expand thermally. The sliding connection, as shown in FIG. 7, comprises pipe sleeve 129 with bushing 128 sliding on rod 130 which is bolted to angle irons 124. Bushing 128 is made from a resilient rubber-like material, which forms an elastic barrier between rod 130 and pipe sleeve 129. The elastic barrier provides the necessary resiliency not unlike helical springs while allowing pan 110 to expand thermally.

I-beams 115 and 116 move in an oscillating motion while being immersed in the liquid inside ducts 109. The ducts are attached on top to cover 108 and immersed in the liquid pool which fills ducts 109 and envelops the I-beams 115 and 116. Duct 109 partitions the liquid pool into an inner liquid column which interfaces with the outside air at 122 and outer liquid column which interfaces with the gases in reservoir 101 at 123. Cap 125 (attached to I-beam 115 and 116) deflects the liquid droplets, which are thrown off due to the oscillating motion of I-beams 115 and 116, into ducts 126 on top of reservoir cover 108. The gases contained under cover 108 are admitted or withdrawn through pipe 107. Solids are deposited by chute 120 on wall 112 and discharged therefrom through duct 119 into chute 121.

In yet another embodiment, the liquid seal comprising ducts 103, 104 and 111 may be altogether eliminated by disposing wall 112 at an angle of about ten degrees to the horizontal. Alternatively, wall 112 may consist of a plurality of segments of which at least the last one, comprising the discharging end, is inclined. Otherwise, this embodiment is not unlike that shown in FIGS. 5 and 6, except that only one end of the inclined wall segment is immersed, whereas the other end protrudes from the liqid pool. By extending the inclined wall segment to the outside of reservoir 101, the solids can be discharged directly from pan 110, instead of into duct 111.

DESCRIPTION OF THE PROCESS FOR RETORTING OIL SHALE

Figure 2:
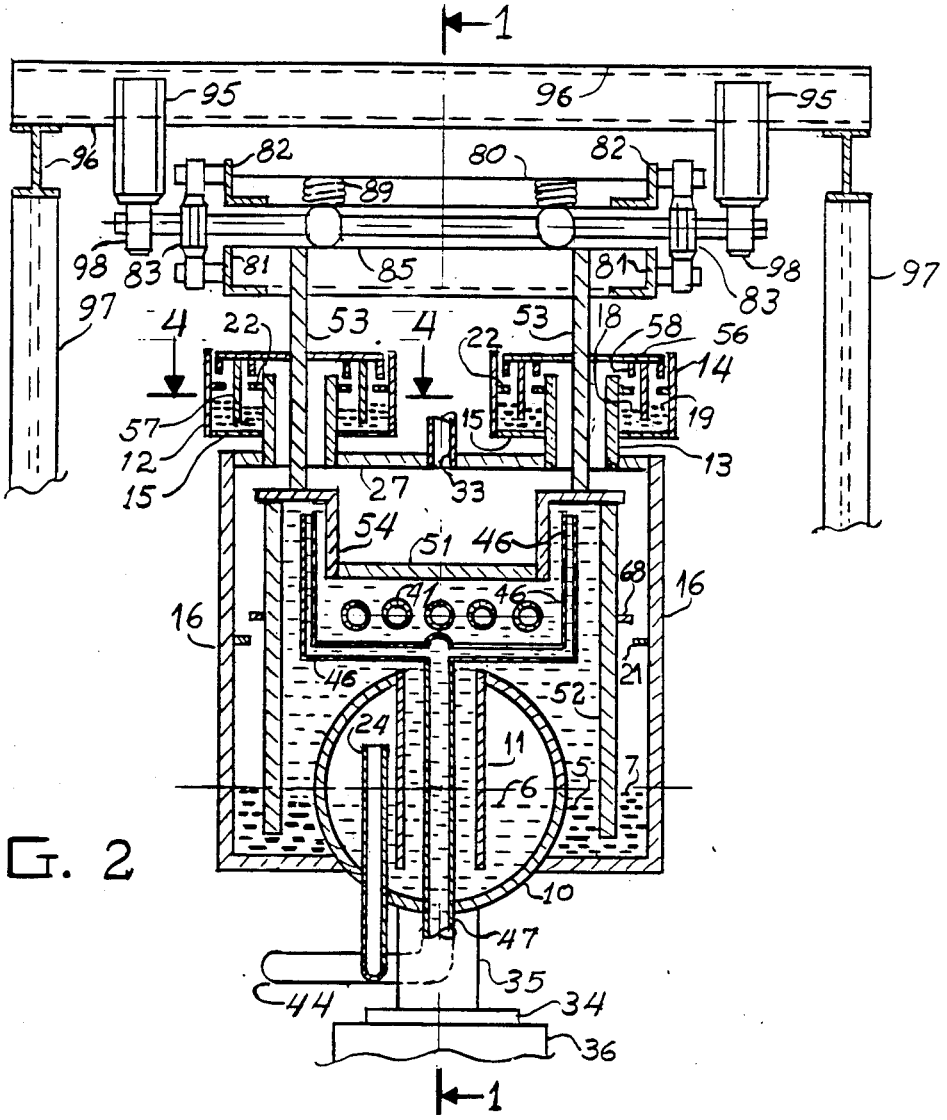
FIG. 2 is a side view on the heat exchanger, in section, taken along line 2—2 shown in FIG. 1.
Figure 3:
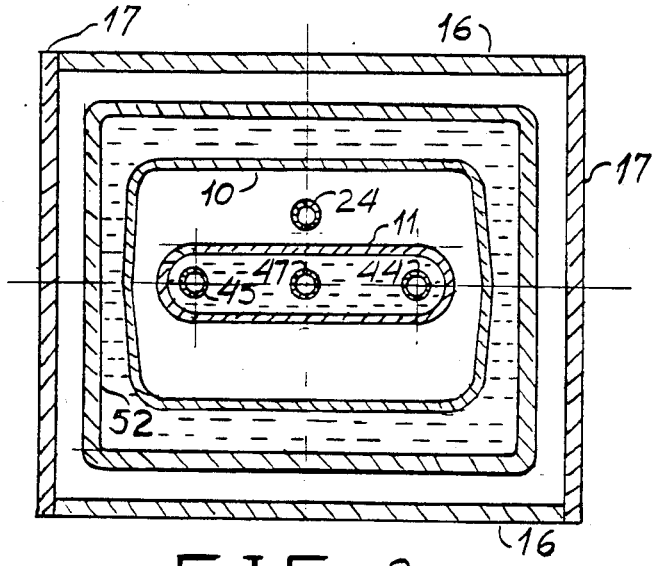
FIG. 3 is a top view of the heat exchanger, in section, taken along line 3—3 shown in FIG. 1.
Figure 4:
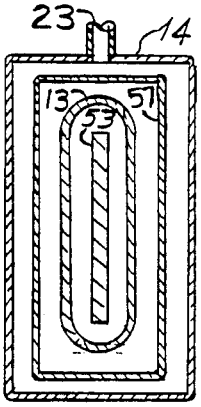
FIG. 4 is a top view of the liquid seal embodiment of the heat exchanger of this invention, in section, taken along line 4—4 shown in FIG. 2.

The process for retorting oil shale is illustrated in FIG. 8 in which features found in FIGS. 1, 2 and 3 are referred to with like reference numerals, except as hereinafter noted. The process which is especially useful for retorting of oil shale is, however, equally applicable to other carbon-containing solids.

In FIG. 8, the liquid pools in Sections A and C comprise a single liquid which in this case is a heat transfer oil. The conduits 41 in Sections A and C are eliminated leaving conduit manifolds 42 and 43 with a plurality of short conduit stubs. The heat transfer oil flows out from the studs of conduit 42, thence across the space under wall 51, and thereafter enters the stubs of conduit 43. The liquid pool in Section B comprises the Na-K liquid and the buffer liquid with conduit assembly 40 remaining intact. Conduits 24, 33 and 47 from all the reservoirs 1 are manifolds together and connected to nitrogen tank 76, product tank 74 and purge tank 77, respectively.

Pressure $p_7$ which is in effect the retorting pressure, is set by controlling the pressure in product tank 74 which, in this example, is set at a reduced pressure. Th hydrocarbonaceous product, produced as a result of the decomposition of the kerogen in the oil shale under the influence of heat, is withdrawn from the conveying path as a result of the reduced pressure.

The pressure in nitrogen tank 76 is controlled such that $p_6$ is equal to $p_7$ thereby equalizing $h_5$ and $h_6$ with $h_7$. The liquid employed in liquid seals 12 is water which is exposed to temperatures up to its boiling point. Water which is boiled off is replaced from seal tank 75 utilizing conduits 23 to which all liquid seals 12 are connected (for the sake of clarity, only one such connection is shown in FIG. 8); the steam resulting from the boiling off of the water mixes with the hydrocarbonaceous product. For the sake of clarity, conduits 44 and 45 entering and exiting from all Sections are identified with the letter denoting that particular Section. For example, reference numeral 44A denotes conduit 44 through which the fluid enters Section A.

Raw oil shale which has been mined and crushed to a particle size less than ¼ inch is deposited at a constant rate from hopper 38 onto the first pan 50. The oil shale is conveyed by an oscillating motion thru the retorting and cooling zones in one continuous conveying path and discharged from the last pan 50 into hopper 39. Sections A and B are segments of the retorting zone and Section C is the cooling zone. The oil shale being heated first in the retorting zone and then cooled in the cooling zone enter and departs from the conveying path at temperatures which are substantially below the peak retorting temperature. This prevents the agglomeration of oil shale particles and other flow upsets which are more likely to occur in the transfer of the hot oil shale particles than in the conveying thereof.

The heat transfer oil flows at a predetermined rate thru cooler 79 to pump 72 and is pumped thru Sections C and A. The liquid pool in Section C absorbs heat from the oil shale which is cooled down from its peak retorting temperature to a lower temperature. The pumped heat transfer oil transfers this rejected heat from the liquid pool in Section C to the liquid pool in Section A, which in turn transfers this heat to the oil shale being retorted. The oil shale is further heated in Section B by exchanging heat with a gaseous fluid, such as for example a hydrogen-nitrogen gas mixture. The gaseous fluid, which is circulated by circulator 73 between conduit assembly 40 and the piping coil in heater 71, absorbs heat from the combustion of fossil fuels and transfers this heat to the liquid pool in Section B. Unlike in the other sections, the liquid pool in Section B comprises liquid metals because they are the only practicable liquid heat transfer media which are capable of heating the oil shale to the temperatures that are encountered in the last retorting interval. Theoretically the Na-K liquid in Section B could be heated by being pumped thru the piping coil in heater 71. However, there are distinct advantages to heating the Na-K liquid by means of conduit assembly 40 because a number of safety hazards, which are inherent to the flow of liquid metals, are thereby avoided. The heat contained in the flue gases exiting heater 71 is recovered in air preheater 78.

The heating scheme shown in FIG. 8 is but one of many, in which the heat for retorting is obtained in part by recovery from Section C and augmented with heat from fossil fuels in heater 71. For example, the heat obtained from Section C can be augmented in heater 71, prior to being transferred to Sections A and B, which are combined in this scheme into one Section. Unlike in FIG. 8, Sections A and C as well as Section B comprise conduit assemblies 40 fully intact. The gaseous fluid exiting 45A flows through cooler 79 into circulator 73 thereby eliminating the need for pump 72. The fluid flows from circulator 73 to 44C, exiting from 45C and entering heater 71. The fluid after being heated in heater 71 enters 44B and flows through Sections A and B exiting through 45A and repeating the cycle. This heating scheme, although different from the scheme shown in FIG. 8, accomplishes nonetheless, the same objective, which is to transfer heat from the liquid pools in the cooling zone to the liquid pools in the retorting zone, while the oil shale is conveyed through both zones in one continuous path. The amount of heat thus transferred reduces the fuel consumption in heater 71. The fuel savings, which are large, can be substantially the same in both heating schemes, depending primarily on the length of the conveying path. The foregoing description of the apparatus and process of my invention is not to be taken as limiting my invention but only as illustrative thereof since many variations may be made by those skilled in the art without departing from the scope of the following claims.

What is claimed is:

1. A liquid to solids heat exchanger wherein there is no direct contact between the liquid and the solids comprising:

(a) a liquid pool within a reservoir;

(b) means for heating or cooling said liquid pool;

(c) at least one wall having side walls, said wall having a top surface and a bottom surface, said wall with said side walls being immersed in said liquid pool such that the bottom surface but not the top surface is in contact with the liquid pool; and (d) means for imparting an oscillatory motion to said wall relative to said reservoir thereby causing any solids present on said top surface to be conveyed along the top surface while exchanging heat with the liquid pool.

2. The heat exchanger according to claim 1 wherein:

(a) the reservoir has an opening with an annulus surrounding the periphery of the opening;

(b) said wall contains a chute through which the solids are discharged, said chute being disposed within the annulus, said annulus containing at least one liquid dissimilar from at least one liquid present in the liquid pool, the liquid in the annulus forming a liquid seal between said chute and said reservoir.

3. The heat exchanger according to claim 1 wherein at least part of the wall is inclined at an angle which will still permit solids to be conveyed and discharged therefrom.

4. The heat exchanger according to claim 1 wherein said means for heating or cooling comprises a fluid flow through conduits immersed in said liquid pool, said fluid absorbing or rejecting heat externally to said liquid pool.

5. The heat exchanger according to claim 1 wherein said means for heating or cooling comprises a stream withdrawn from the liquid pool, pumped through an external heat source or heat sink, and returned to the liquid pool.

6. The heat exchanger according to claim 1 wherein the wall comprises a plurality of walls disposed so as to form a substantially continuous conveying path.

7. The heat exchanger according to claim 1 wherein said liquid pool comprises a plurality of liquids.

8. The heat exchanger according to claim 1 comprising a plurality of liquid pools.

9. The heat exchanger according to claim 1 wherein said reservoir contains a plurality of partitions which divide the liquid pool into liquid columns which are in a pressure balance with one another.

10. The heat exchanger according to claim 1 wherein said reservoir is totally enclosed and gas-tight and said wall is enclosed within said reservoir.

11. The heat exchanger according to claim 1 wherein the means for imparting oscillatory motion to said wall communicates with the wall by connecting means.

12. The heat exchanger according to claim 11 wherein at least one of the connecting means contains a rod slidably mounted within a resilient bushing comprised of a rubber-like material.

13. The heat exchanger according to claim 1 wherein the solids are carbon-containing solids.

14. A liquid to solids heat exchanger wherein there is no direct contact between the liquid and the solids comprising:

(a) a liquid pool within a reservoir;

(b) means for heating or cooling said liquid pool;

(c) at least one wall for supporting the solids, said wall having a top surface and a bottom surface, a duct communicating with and disposed beneath said bottom surface such that the bottom surface forms a closure for one end of the duct, the other end of the duct being immersed in said liquid pool such that the bottom surface but not the top surface of said wall is in contact with the liquid pool and the level of the liquid pool within the duct is at a higher elevation than the level of the liquid pool outside the duct; and (d) means for imparting an oscillatory motion to said wall relative to said reservoir thereby causing any solids present on said top surface to be conveyed along the top surface while exchanging heat with the liquid pool.

15. The heat exchanger according to claim 14 wherein said means for heating or cooling comprises a fluid flow through conduits immersed in said liquid pool, said fluid absorbing or rejecting heat externally to said liquid pool.

16. The heat exchanger according to claim 14 wherein said means for heating or cooling comprises a stream withdrawn from the liquid pool, pumped through an external heat source or heat sink, and returned to the liquid pool.

17. The heat exchanger according to claim 14 wherein the wall comprises a plurality of walls disposed so as to form a substantially continuous conveying path.

18. The heat exchanger according to claim 17 wherein the walls are disposed in substantially one plane.

19. The heat exchanger according to claim 14 wherein said liquid pool comprises a plurality of liquids.

20. The heat exchanger according to claim 14 comprising a plurality of liquid pools.

21. The heat exchanger according to claim 14 wherein said reservoir contains a plurality of partitions which divide the liquid pool into liquid columns which are in a pressure balance with one another.

22. The heat exchanger according to claim 14 wherein said reservoir is totally enclosed and gas-tight and said wall is enclosed within said reservoir.

23. The heat exchanger according to claim 14 wherein the means for imparting oscillatory motion to said wall communicates with the wall by connecting means.

24. The heat exchanger according to claim 23 wherein at least one of the connecting means contains a rod slidably mounted within a resilient bushing comprised of a rubber-like material.

25. The heat exchanger according to claim 14 wherein the solids are carbon-containing solids.

* * * * *